US006821345B2

(12) United States Patent
Obermark

(10) Patent No.: US 6,821,345 B2
(45) **Date of Patent: *Nov. 23, 2004**

(54) ROLLER COATER APPARATUS

(75) Inventor: John A. Obermark, Beloit, WI (US)

(73) Assignee: LSP Industries, Inc., Rockford, IL (US)

( * ) Notice: Subject to any disclaimer, the term of this patent is extended or adjusted under 35 U.S.C. 154(b) by 113 days.

This patent is subject to a terminal disclaimer.

(21) Appl. No.: 10/077,217

(22) Filed: Feb. 15, 2002

(65) Prior Publication Data

US 2002/0073920 A1 Jun. 20, 2002

Related U.S. Application Data

(63) Continuation-in-part of application No. 09/439,869, filed on Nov. 12, 1999, now Pat. No. 6,521,044.

(51) Int. Cl.[7] ..... B05C 1/00
(52) U.S. Cl. ..... 118/227; 118/684
(58) Field of Search ..... 100/170, 160; 118/248, 249, 114–118, 121–123, 227, 228, 262, 244, 684; 184/17

(56) References Cited

U.S. PATENT DOCUMENTS

| | | | |
|---|---|---|---|
| 3,582,428 | A | 4/1969 | Steinberg |
| 3,800,742 | A | 4/1974 | Hunter |
| 4,485,132 | A | 11/1984 | Furuzono et al. |
| 5,221,350 | A | 6/1993 | Tallier et al. |
| 5,476,546 | A | 12/1995 | Zibulla |
| 5,679,162 | A | 10/1997 | Caffrey et al. |
| 5,743,964 | A | 4/1998 | Pankake |
| 5,755,883 | A | 5/1998 | Kinose et al. |
| 6,152,068 | A | 11/2000 | Colson et al. |

*Primary Examiner*—Brenda A. Lamb
(74) *Attorney, Agent, or Firm*—Leydig, Voit & Mayer, Ltd.

(57) ABSTRACT

An apparatus for coating sheet metal strip substrate with lubricant type laminate includes top and bottom roller coaters for pinching the metal therebetween to apply laminate. The roller coaters are movable between engaged and disengaged positions. Pneumatic cylinders for actuating the top and bottom roller coaters are operatively connected such that the top and bottom roller coaters can "float" or move vertically while at the same time pinching the metal strip therebetween. The roller coaters comprise roller coater carriages that carry applicator rolls between support rolls without the need to journal ends of the applicator roll. A spring biased applicator head applies laminate directly to one or more sections of the applicator roll.

45 Claims, 16 Drawing Sheets

ROLLER COATER APPARATUS

CROSS-REFERENCE TO RELATED PATENT APPLICATIONS

This patent application is a continuation-in-part of U.S. patent application Ser. No. 09/439,869, filed Nov. 12, 1999. now U.S. Pat. No. 6,521,044.

FIELD OF THE INVENTION

The present invention generally relates to roller coater type apparatus which are used to apply laminate to a substrate, and more particularly to a roller coater for coating one or both sides of a sheet metal strip fed along a predetermined path, such as for example into a press.

BACKGROUND OF THE INVENTION

In the metal forming industry, apparatus commonly known as roller coaters are used to apply a lubricant type laminate to sheet metal strip substrate. The lubricant laminated sheet metal is then typically fed into a press which punches and forms the sheet metal into patterns as desired. The lubricant performs the desirable function of lubricating the tooling of the press when it is working the metal. Sometimes it is desirable to switch the type of lubricant depending upon the particular types of operations being performed to the metal. It is usually desirable to coat both sides of the sheet metal strip with lubricant although it is occasionally desirable to coat only one side of sheet. It may also be desirable to change the width of the laminate application depending upon the width of the metal strip or the operations of the downstream press.

In the sheet metal lubrication industry, the typical roller coater apparatus includes upper and lower roller coater assemblies for application of lubricant to both sides of the sheet metal substrate. The upper and lower roller coaters include respective applicator rolls which pinch the sheet metal strip therebetween to apply lubrication to the top and bottom sides of the sheet metal strip. The applicator rolls are journalled in bearings at their ends for rotation about parallel rotational axes.

Heretofore, prior roller coater apparatus have had several drawbacks. One drawback is that there is typically a substantial amount of downtime and labor required when changing applicator rolls to apply different types of laminate. Another drawback is that roller coaters have less than desirable lubricant application that is either non-uniform or uneven, particularly where a small application rate is desired. This often results in wasted lubricant or alternatively a poorly lubricated press. Yet another drawback is that roller coater apparatus have not been able to adapt to changes in feed of the sheet metal strip.

BRIEF SUMMARY OF THE INVENTION

One aspect of the present invention is directed towards the novel provision of pneumatic vertical floatation of the top and bottom roller coater assemblies of a roller coater apparatus. According to this aspect, the roller coater apparatus includes top and bottom roller coater assemblies which are adapted to pinch metal strip therebetween to selectively coat one or both sides of the metal strip with lubricant. A pneumatic cylinder assembly is provided that is capable of moving upward and downward along with variations of the vertical height of the metal strip. To accomplish this, at least one pneumatic cylinder assembly is provided that includes top and bottom pneumatic cylinders. The top pneumatic cylinder operates the upper roller coater assembly while the bottom pneumatic cylinder operates the lower roller coater assembly. The top and bottom cylinders have fluidically connected chambers or a common chamber that equalizes pressure and allows the cylinders to move upward and downward in unison without changing the pinching force applied to the sheet metal strip therebetween.

Another aspect of the invention is directed toward a novel support arrangement for the applicator roll of a roller coater apparatus which is used to apply lubricant or other laminate to metal strip. The apparatus generally may include top and bottom roller coaters (but may also be applicable to a single roller coater) which are adapted to pinch metal strip or other substrate material therebetween in an engaged position. The support of the applicator roll is accomplished by at least two discrete supports such as support rolls that engage the applicator roll at different angular locations such that the applicator roll may be carried without the need to journal the ends of the applicator roll.

A further aspect of the present invention is directed towards the provision of a novel lubricant applicator assembly in which a lubricant dispensing head applies lubricant directly to the surface of the applicator roll. The dispensing head has a concave recessed surface that receives the outer periphery of the applicator roll. The dispensing head includes an elongated outlet in the recessed surface which receives laminate and applies laminate directly to the applicator roll.

Other object and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
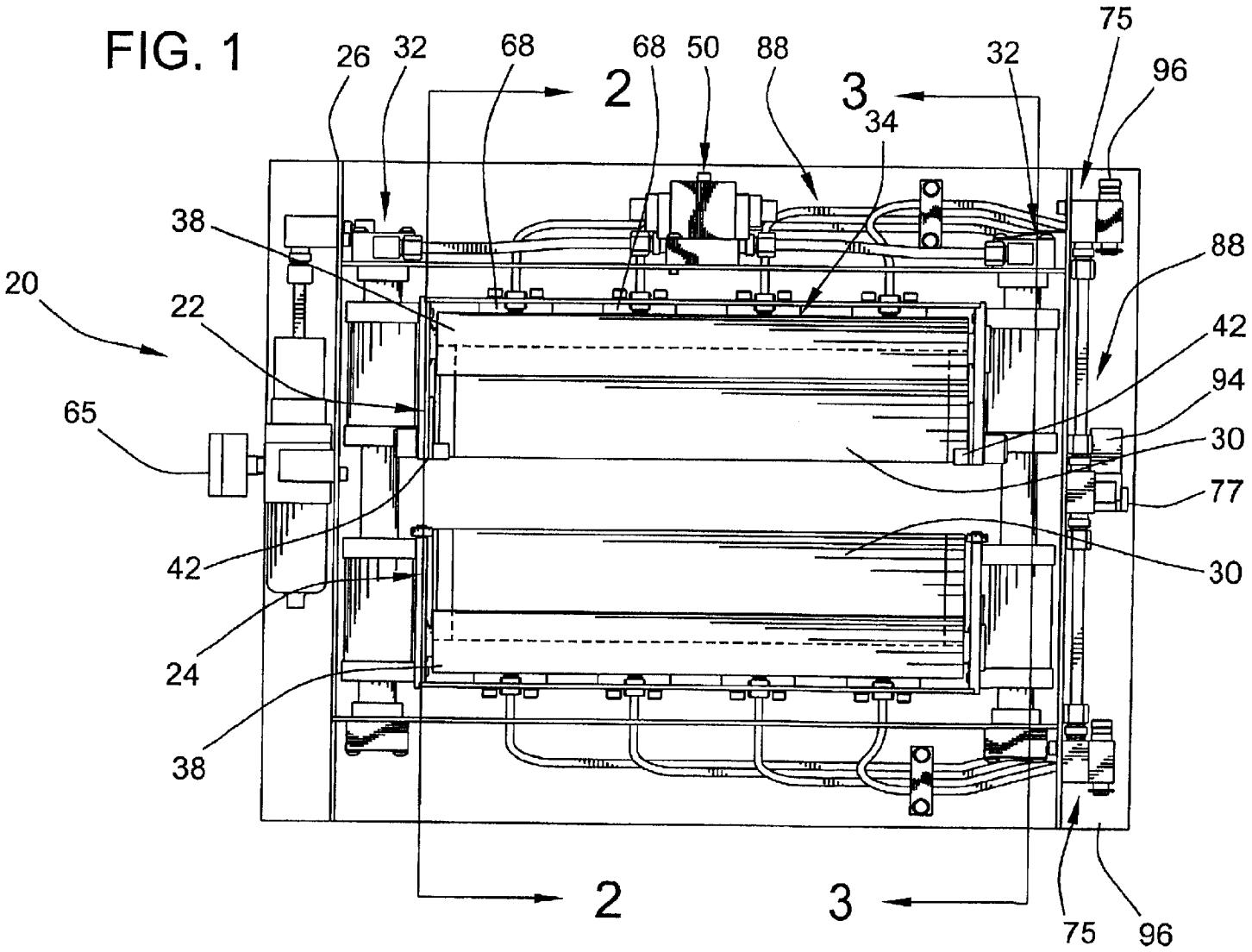
FIG. 1 is a front elevation view of a roller coater apparatus for applying laminate to sheet metal strip, illustrated in a disengaged position, according to a first embodiment of the invention.
Figure 2:
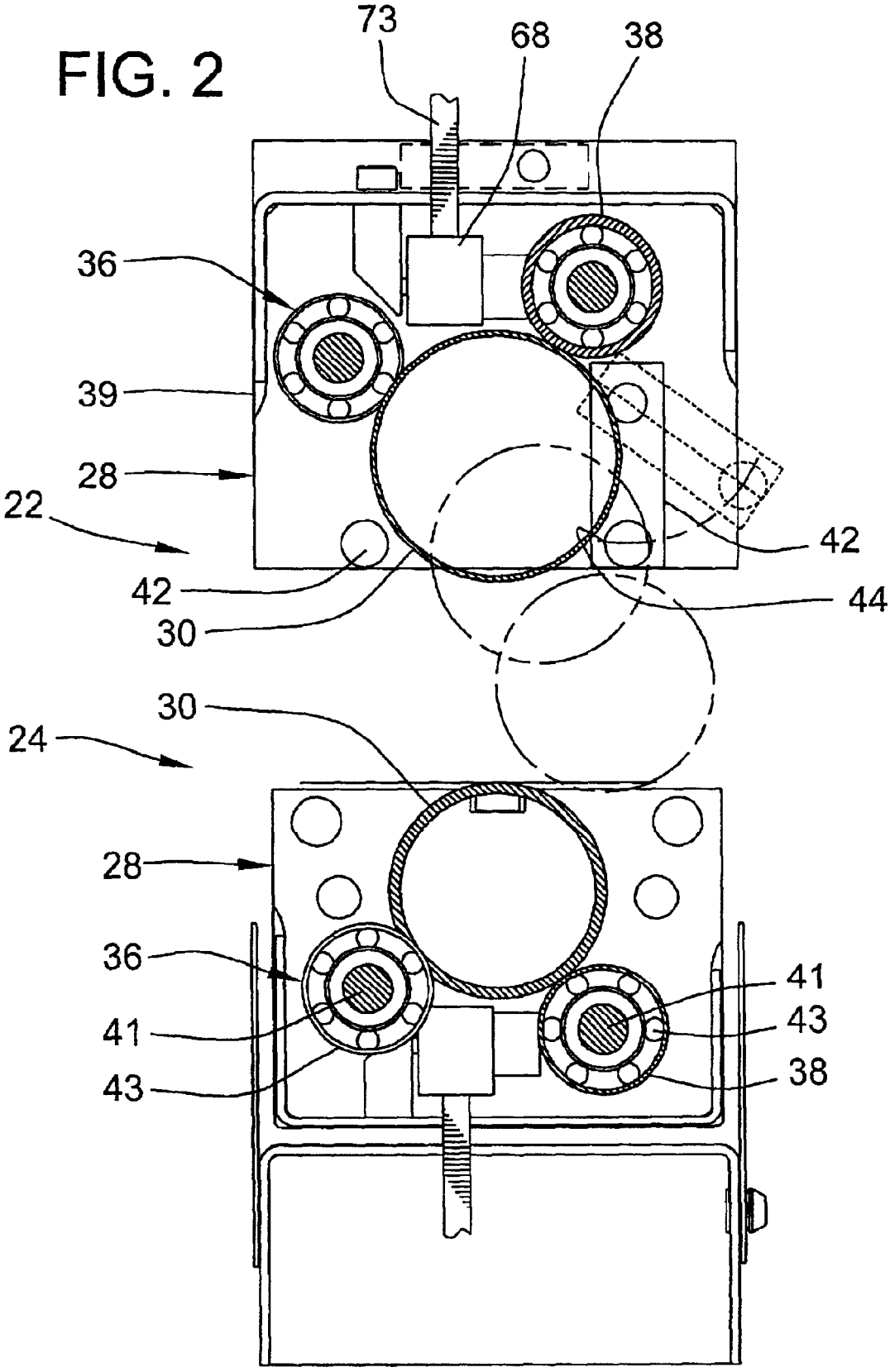
FIG. 2 is a cross-section of the roller coater apparatus of FIG. 1 taken about line 2—2, with hidden lines indicating how the applicator roll is removed.
Figure 9:
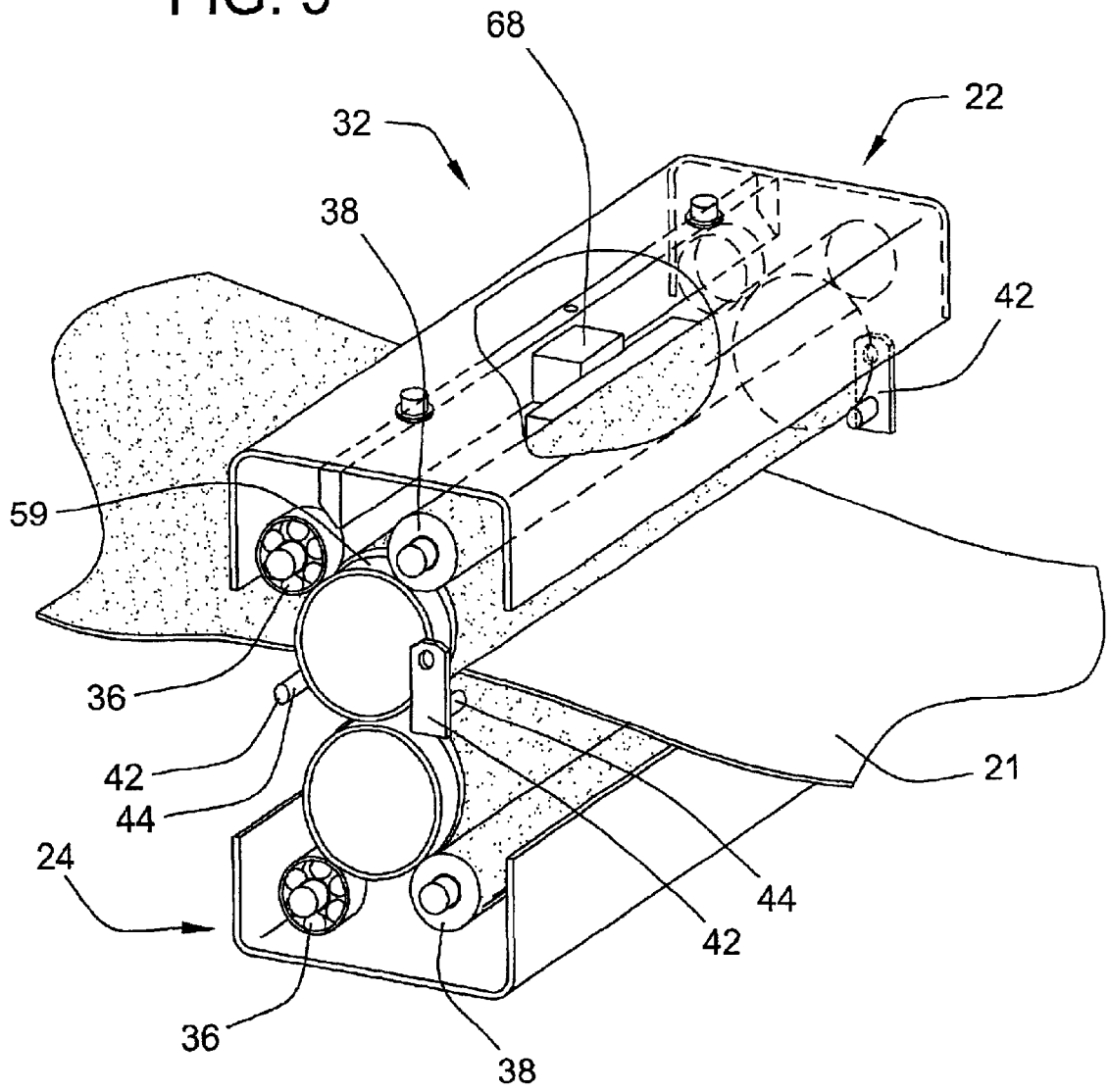
FIG. 9 is a perspective view of certain working parts of the roller coater apparatus shown in FIG. 1, illustrated in an engaged position.

Referring to FIGS. 1, 2 and 9, a roller coater apparatus 20 for applying laminate to sheet metal is illustrated in accordance with a first embodiment of the present invention. The roller coater apparatus 20 is adapted to coat one or both sides of sheet metal strip material 21 with a liquid laminate, such as lubricant. The apparatus 20 is preferably positioned upstream of a press (not shown) that forms metal into desired shapes in mass production operations. With this arrangement, the lubricant on the sheet metal strip material 21 lubricates the movable tools (not shown) of the press to ensure sharper cutting tools and a longer lifespan for the tools.

To facilitate coating of both sides of the metal strip material 21, the apparatus 20 preferably includes top and bottom roller coater assemblies 22, 24 (designated as such for ease of understanding because the top roller coater assembly 22 is typically vertically above the bottom roller coater assembly 24). The roller coater assemblies 22, 24 are carried on a stationary support frame 26 and have generally cylindrical applicator rolls 30 that are adapted to pinch the metal strip material therebetween for application of lubricant to top and bottom sides of the metal strip material 21. During operation, the metal strip material 21 is advanced through the roller coater apparatus 20 towards the press by a feed apparatus that is typically separate from the coater apparatus 20. The advancing movement of the metal strip material 21 drives each of the applicator rolls 30 about an axis of rotation. The rotation of the applicator rolls 30 causes them to receive a controlled amount of lubricant across their surface from a lubricant applicator assembly 34. After receiving the controlled amount of lubricant, the applicator rolls 30 subsequently coat the lubricant across the entire or selected surface areas of the metal strip material 21.

Each roller coater assembly 22, 24 also includes a support carriage 28 carried by the frame 26 for linear movement relative thereto. The carriages 28 are mounted between a pair of pneumatic cylinder assemblies 32 which position the carriages 28 relative to each other. In particular, the pneumatic cylinder assemblies 32 are operable to move the roller coater assemblies 22, 24 closely together or far apart between engaged and disengaged positions, as illustrated with a comparison of FIGS. 1 and 9. In the engaged position, the applicator rolls 28 pinch the metal strip material 21 therebetween for application of lubricant. In the disengaged position, the applicator rolls 28 are spaced vertically apart from each other to facilitate service maintenance and/or loading of new stock material to the roller coater.

Figure 11:
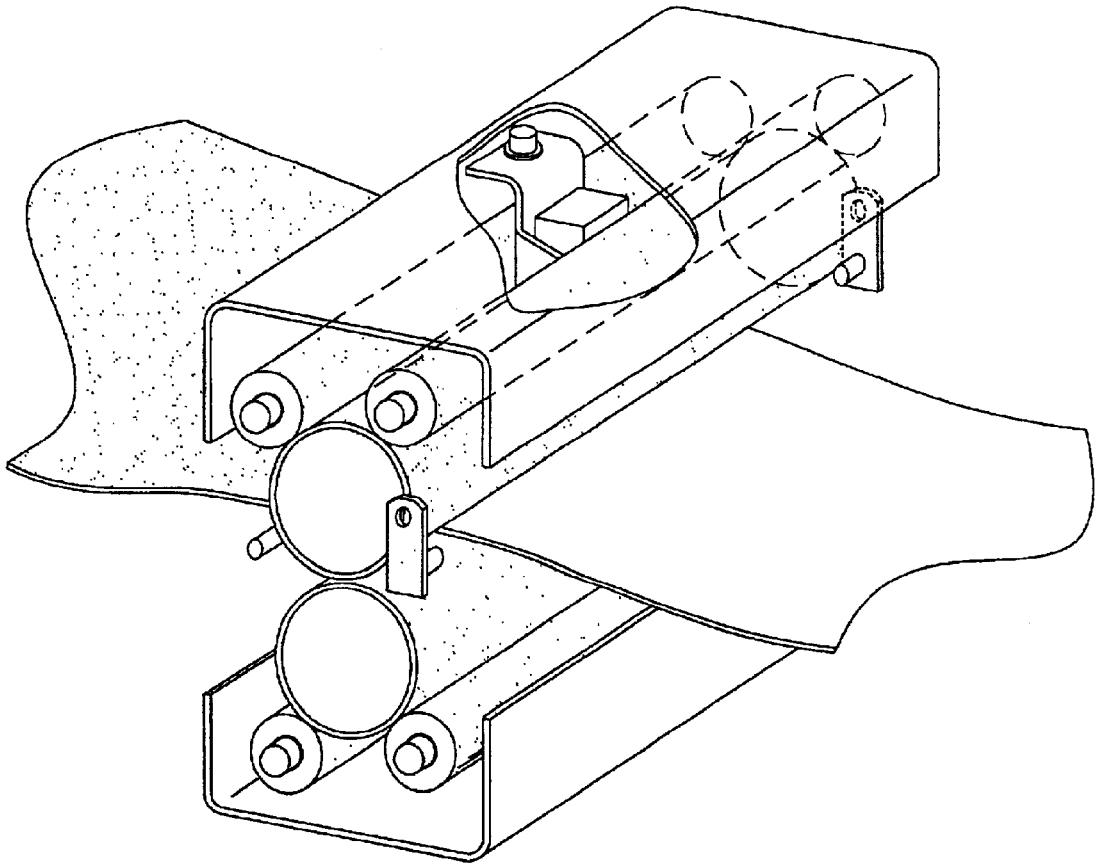
FIG. 11 is a perspective view of certain working parts of a roller coater apparatus according to an alternative embodiment of the present invention.

It is an aspect of the present invention that the applicator rolls are carried between three contact points while in the engaged position, such that a mechanical connection between the applicator roll 30 and the support carriage 28 is not necessary. To provide two of the contact points, a pair of supports which take the form of a bearing roller 36 and a transfer roll 38 are provided for each of the respective top and bottom roller coater assemblies 22, 24. However, other supports and support combinations may also be used such as two support rolls as shown in alternative embodiment of FIG. 11, and/or other similar such support means as a low friction skid support surface. It should be noted that supports which rotate with the applicator rolls are preferred for durability and reliability reasons. In either event, the preferred embodiment of each support includes a stationary support shaft 41 mounted to the support structure 39 of the carriage 28 and ball or roller bearings 43 for facilitating rotation of the roll followers. The rotational axes of the bearing roller 36 and transfer roll 38 are generally parallel with the rotational axis of the applicator roll 30. In the top roller coater assembly 22 the support rolls bearing roller 36 and transfer roll 38 provide support to the top side of the applicator roll 30. In the bottom roller coater assembly 24, the reverse is true, namely, the bearing roller 36 and transfer roll 38 provide support to the bottom side of the applicator roll 30. The bearing roller 36 and transfer roll 38 are preferably made of rigid material such as steel to facilitate proper alignment of the respective applicator rolls 30 of the top and bottom roller coater assemblies 22, 24.

The bearing roller 36 and transfer roll 38 provide two contact points for support of the applicator roll 30. When the roller coater assemblies 22, 24 are in the engaged position, the sheet metal strip material 21 provides the third contact point, and the pinching force between the top and bottom roller coater assemblies 22, 24 maintains the applicator rolls 30 against the bearing roller 36 and transfer roll 38. When the roller coater assemblies 22, 24 are moved apart from each other to the disengaged position, the support provided by the sheet metal strip material 21 ceases to exist. In the bottom roller coater assembly 24, this is of little significance as gravity maintains the applicator roll 30 against the bearing roller 36 and transfer roll 38 for support. However, in the top roller coater assembly 22, gravity causes the applicator roll 30 drop downward away from the bearing roller 36 and transfer roll 38. As such, the preferred embodiment includes means for supporting the upper applicator roll 30 in the disengaged position, which takes the form of two support arms 42 on the top roller coater assembly 22. The support arms 42 include beveled or cylindrical contact surfaces 44 that provide two contact points to support the bottom side of the applicator roll. The contact surfaces 44 are located in close proximity to the outer peripheral surface of the applicator roll 30 while in the engaged position such that the applicator roll moves downward only slightly when the top roller coater assembly moves into the disengaged position. Alternatively, the arms 42 could carry small rolls or rollers if desired to provide the contact points which could also continuously contact the applicator rolls. In the preferred embodiment, the support arms 42 are connected to the support structure 39 of the upper carriage 28, and selectively held in position by a pair of manually operable spring loaded locking mechanisms 47 mounted to the support structure at opposing ends of the roller coater 22.

At least one of the arms 42 is movable between supporting and non-supporting positions to facilitate removal of the applicator roll 30 if desired. As shown in FIG. 2, one of the arms 42 is pivotably connected to the carriage 28 and is capable of being locked in a conventional manner in the supporting position for support of the applicator roll 30. It is an advantage that facilitates easy changing of applicator rolls 30. Applicator rolls may be changed when worn or damaged or alternatively when switching between two different types of lubricant, or other maintenance reason. Little labor and effort is necessary to change the applicator roll as the applicator roll 30 drops down once the support arm 42 is moved to the non-supporting position. It should be noted that the applicator roll 30 of the bottom roller coater assembly 30 may be easily lifted off the bearing roller 36 and transfer roll 38 to facilitate changing of the applicator roll 30. It is an advantage that the applicator rolls 30 do not need an axle journalled in bearings for support or location.

Figure 10:
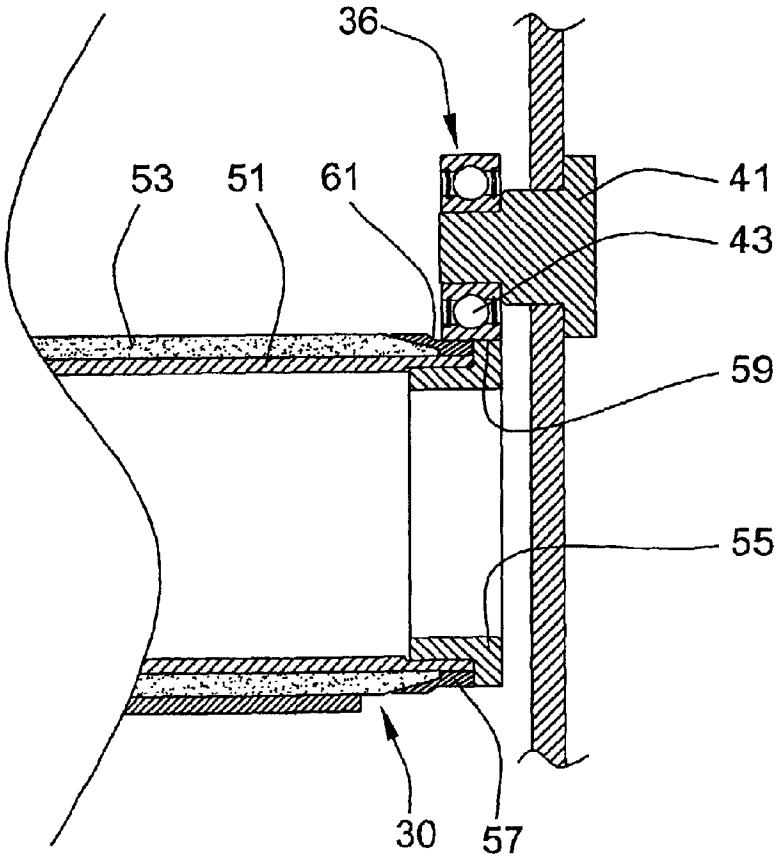
FIG. 10 is a cross section of certain parts of a roller coater of the roller coater apparatus illustrated in FIG. 1.
Figure 10:
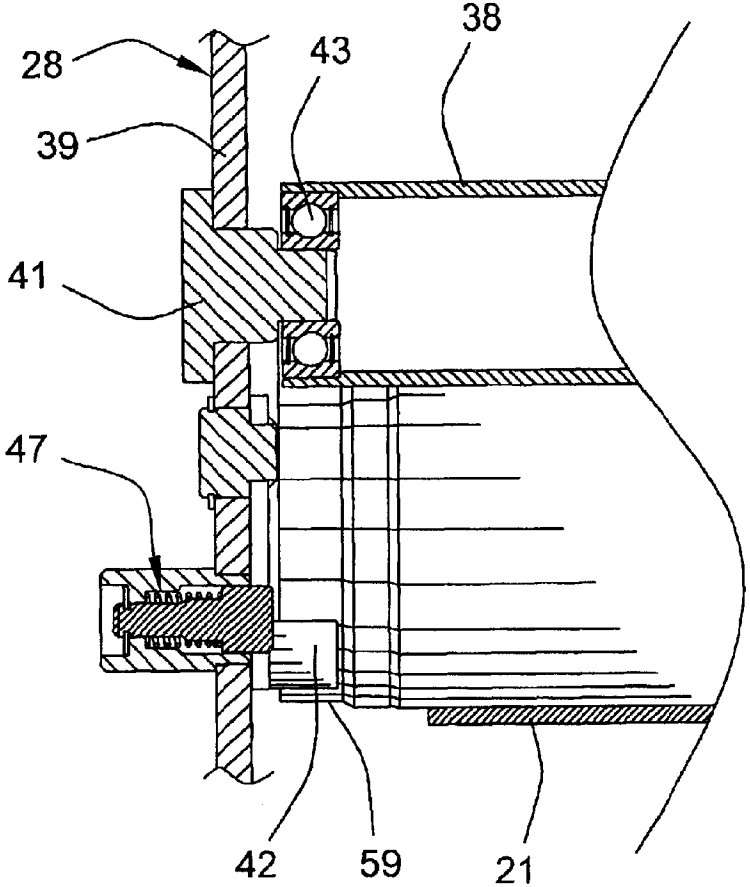

Greater detail of an embodiment of the applicator roll 30, the supports in the form of a bearing roller 36 and transfer roll 38, the support arm 42 and locking mechanism 47 are illustrated in the partial fragmentary cross section of FIG. 10. As illustrated in FIG. 10, the applicator roll 30 includes a metal cylindrical drum 51, a felt transfer liner 53, a pair of end caps 55 enclosing the ends of the drum 51 and a pair of collars 57 that secure the liner 53 to the drum 51. The collars 57 in combination with the end caps 55 define cylindrical recesses 59 which provide a riding surface for the bearing roller 36. The collars 57 also provide beveled surfaces 61 which act as mechanical stops for axial retention of the applicator roll 30.

Figure 3:
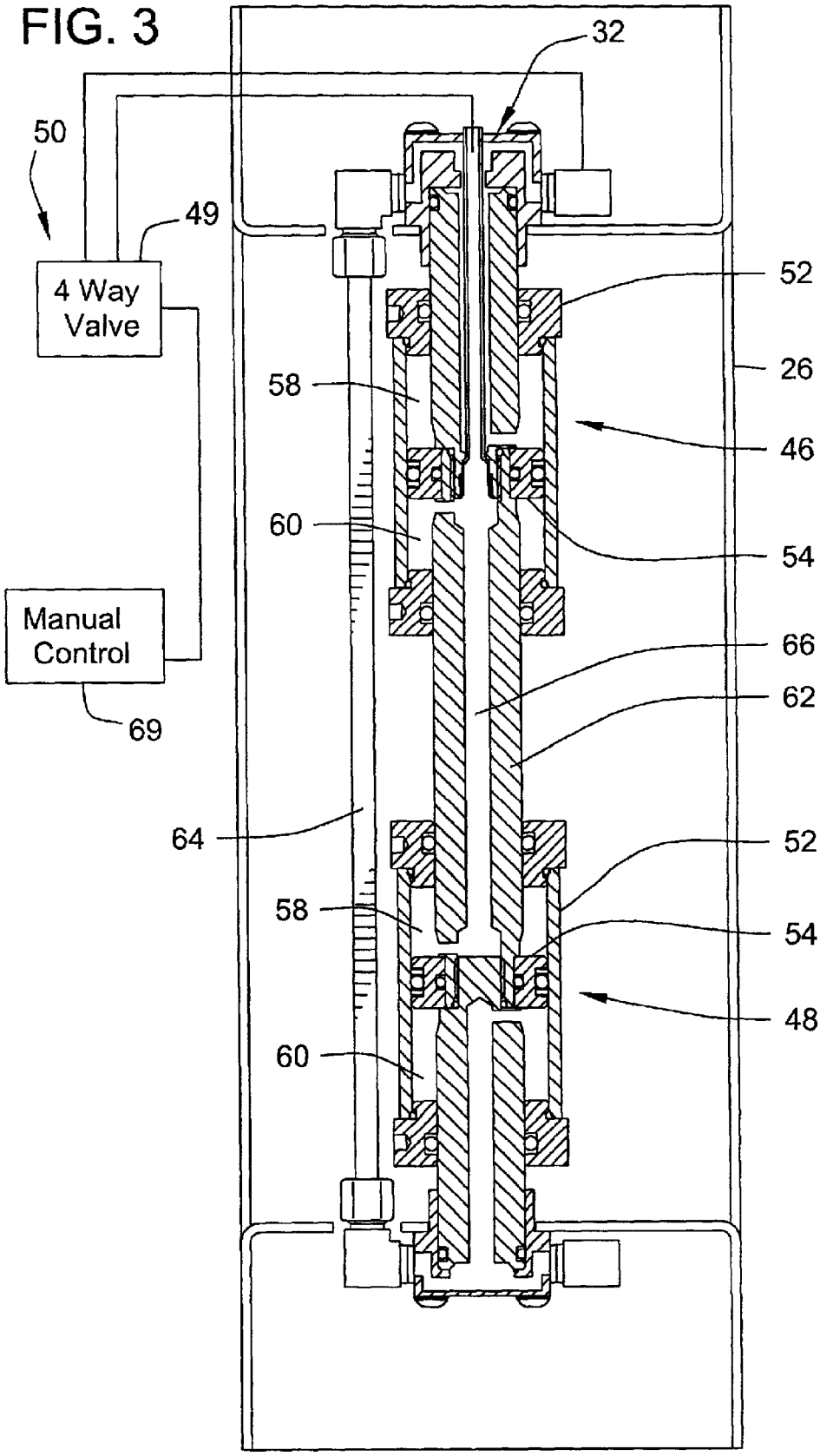
FIG. 3 is a cross-section of the roller coater apparatus of FIG. 1 taken about line 3—3 illustrating the plumbing of the pneumatic cylinder assembly (partially shown in schematic).
Figure 8:
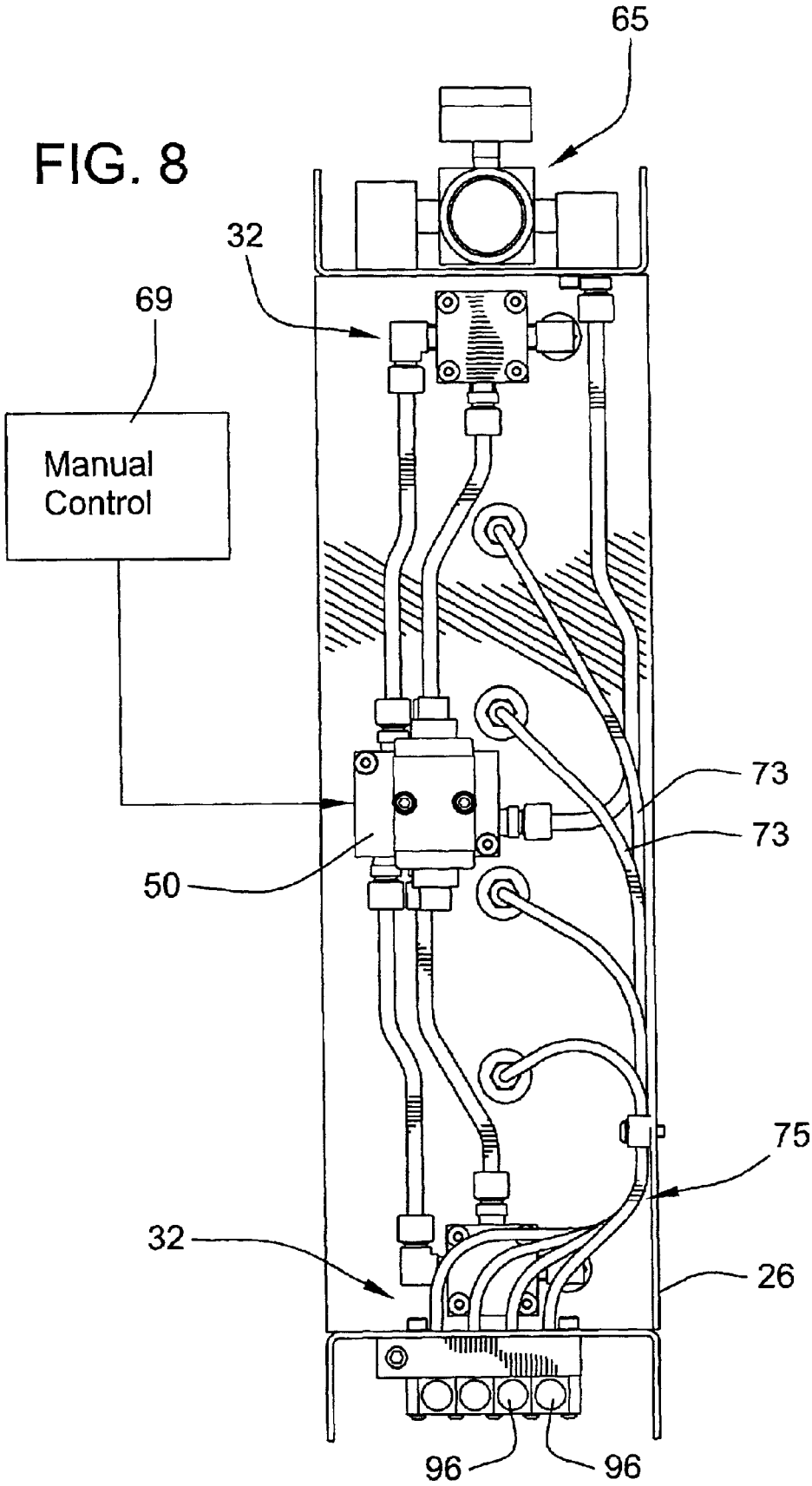
FIG. 8 is a top plan view of the roller coater apparatus illustrated in FIG. 1.

It is another aspect of the present invention, that the pneumatic cylinder assemblies 32 are operatively configured to allow the top and bottom roller coater assemblies 22, 24 to "float" or move vertically upwards or downwards in unison with the feed or flow of the sheet metal strip material 21. For lighter metal strip material the cylinders may also be supported in central position by a vertically adjustable shelf or support bar (not shown). Referring to FIGS. 1, 3 and 8, the pneumatic cylinder assemblies 32 generally include top and bottom pneumatic cylinders 46, 48 and a pneumatic control 50 operatively connected to the cylinders 46, 48 for selectively pressurizing or exhausting the pneumatic cylinders 46, 48 to move the support carriages 28 between engaged and disengaged positions. In the preferred embodiment, the pneumatic control 50 comprises a manually operated four-way valve 49 (two three-way valves) pneumatically connected to a compressed air supply 65 (which receives compressed air from a compressor and conditions the air appropriately) and connected to a manual control 69 for control thereby. Each of the pneumatic cylinders 46, 48 includes a cylinder housing 52 and a piston actuator 54. The housing 52 defines a cylindrical control chamber in which the piston actuator 54 is slidably mounted to facilitate linear translation between the piston actuator 54 and the housing 52.

The piston actuators 54 divide each of their corresponding control chambers into top and bottom pressure compartments 58, 60. In the preferred embodiment, the piston actuators 54 are secured to the frame 26 by a central vertical support shaft 62 extending through both top and bottom cylinders 46, 48. The housings 52 are fastened or pinned to the support structures 39 of the carriages 28 such that the cylinder housings 52 are movable relative to the frame 26 while the piston actuators 54 are stationary relative to the frame 26. However, it will be appreciated to one skilled in the art that the reverse could be true with the pistons secured to the carriages and the cylinder housings secured to the frame.

In the engaged position, the bottom compartments 60 of the top cylinders 46 and the top compartments 58 of the bottom cylinders 48 are pressurized to cause the roller coater assemblies 22, 24 to be biased towards one another and thereby pinch the sheet metal strip material 21 therebetween. While in the engaged position, the pneumatic actuator assemblies 32 are configured to allow the top and bottom roller coater assemblies 22, 24 to float in unison vertically upward and downward. To achieve this floatation, the top compartment 58 of each top cylinder 46 is connected by a first conduit 64 to the bottom compartment 60 of the corresponding bottom cylinder 48, and the bottom pressure compartment 60 of each top cylinder 46 is connected by a second conduit 66 to the top compartment 58 of the corresponding bottom cylinder 48 (See FIG. 3). As indicated in the preferred embodiment, the conduits 64, 66 are preferably provided entirely or partially by internal passages in the support shaft 62, or alternatively external hoses or pipes. It is an advantage that the internal passage of conduit 64 reduces the need for hoses on the apparatus 20.

Turning now to other details of the first embodiment, and particularly the lubricant applicator assembly 34, reference can be had to FIGS. 5–8. As illustrated, the lubricant applicator assembly 34 for each of the roller coater assemblies 22, 24 of the first embodiment generally includes at least one and preferably multiple dispensing heads 68 and the transfer roll 38 which as already indicated may also act as a support for the applicator roll 30. In operation, the feed of the sheet metal strip 31 drives the applicator roll 30 which in turn rotates the transfer roll 38 and thereby causes the transfer of lubricant from the heads 68 to the applicator roll 30.

The dispensing heads 68 include an elongated concave recessed surface 70 that is preferably cylindrical such that is closely receives the cylindrical outer periphery of the transfer roll 38. Each of the dispensing heads 68 includes an inlet port 72 for receiving lubricant from the hose 73 of a supply manifold 75, and an elongated outlet 74 that extends across the axial length of the transfer roll 38 for application of lubricant to the transfer roll 38. In the preferred embodiment, the outlet 74 takes the form of a continuous channel 76 formed in the head 68. However, it will be appreciated that multiple spaced apart holes arranged closely together along an axial length may also be used to provide the outlet 74. The outlet 74 is preferably configured to apply a uniform line of lubricant over the transfer roll 38.

Figure 5:
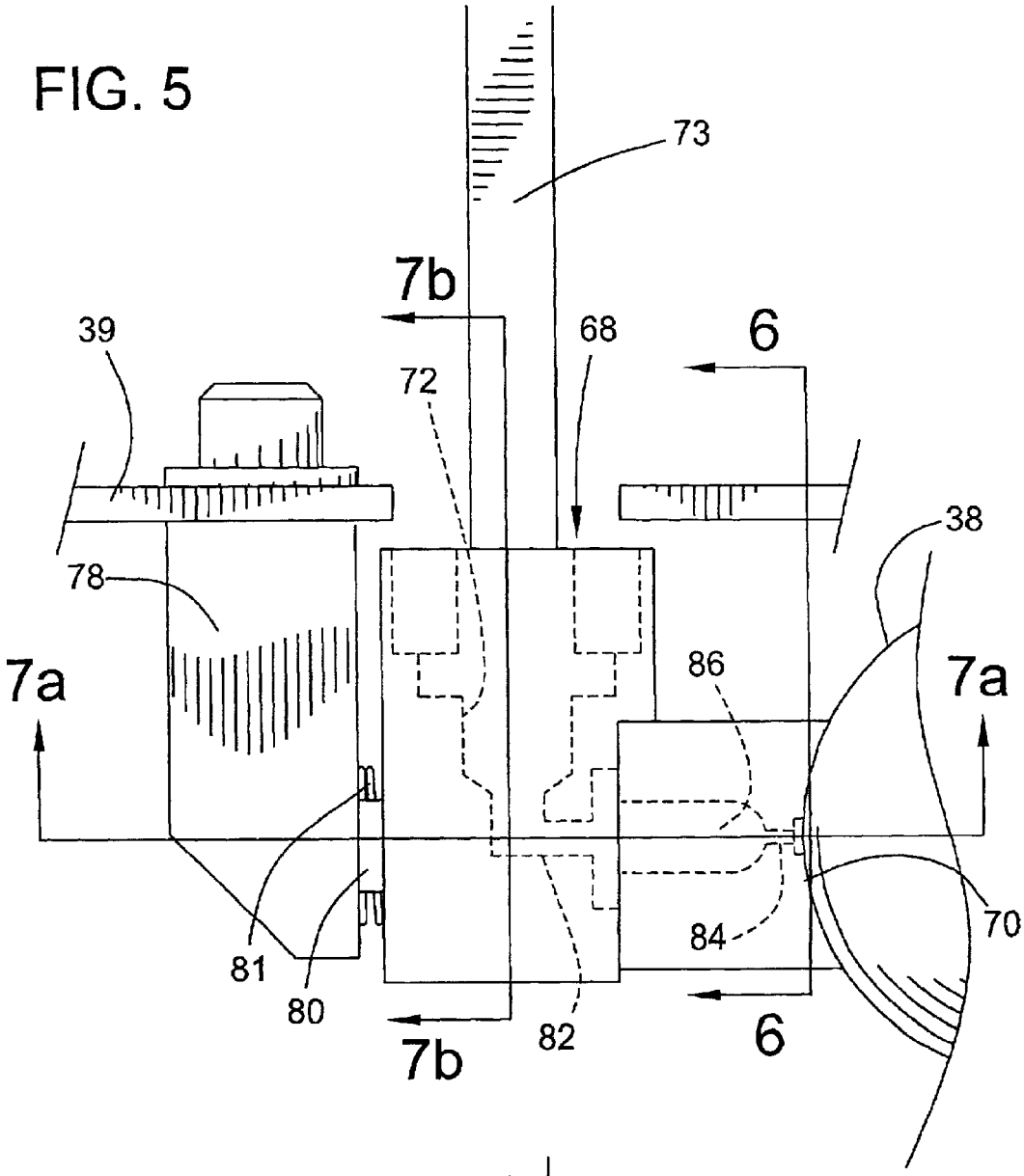
FIG. 5 is a side view of an applicator head used in the roller coater apparatus of FIG. 1.
Figure 6:
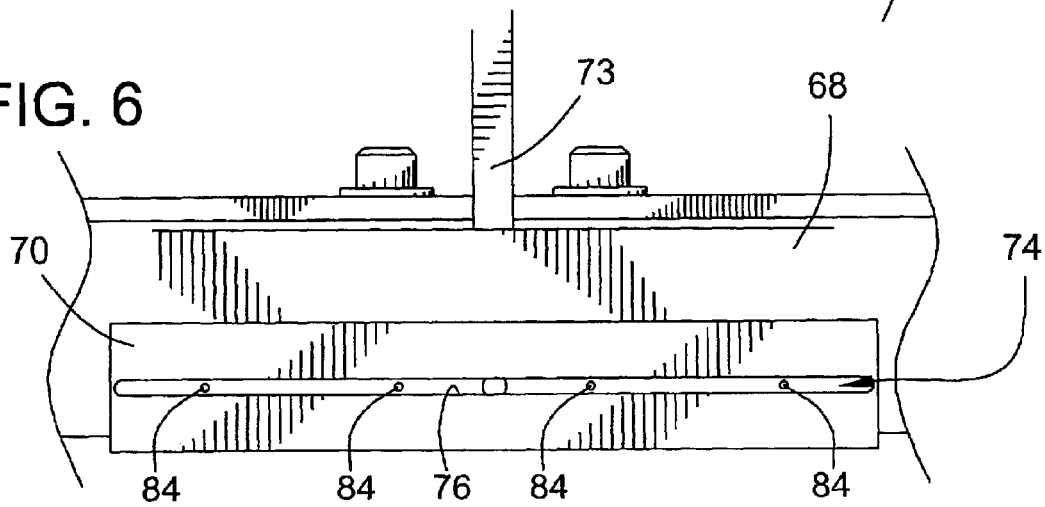
FIG. 6 is a front view of the applicator head shown in FIG. 5.
Figure 7A:
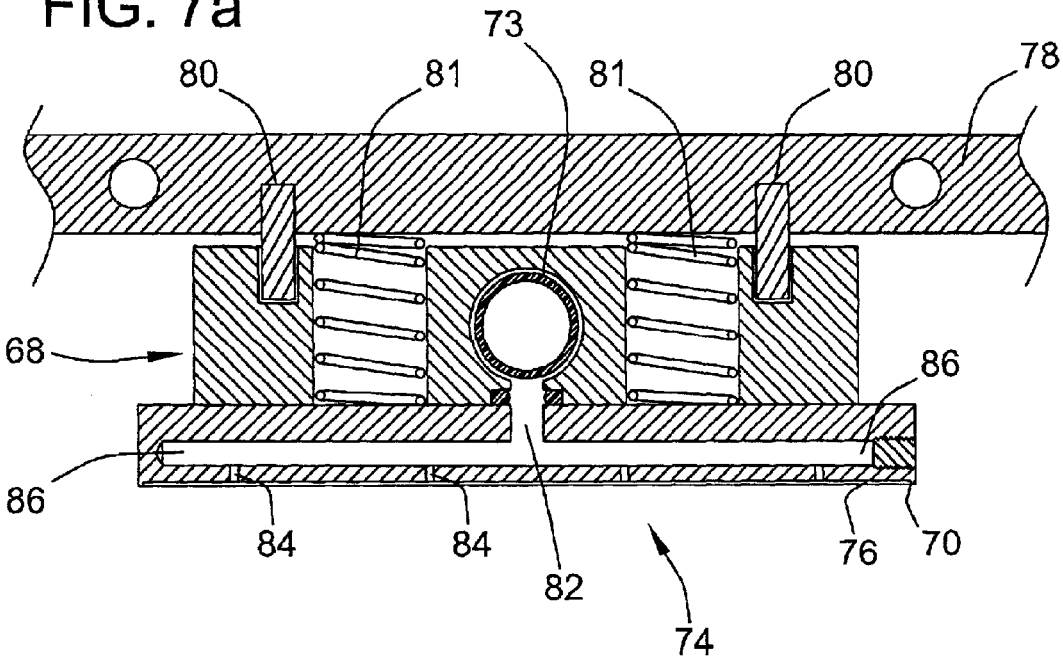
FIGS. 7*a* and 7*b* are cross sections of the applicator head shown in FIG. 5 taken about lines 7*a*–7*a* and 7*b*–7*b*, respectively.
Figure 7B:
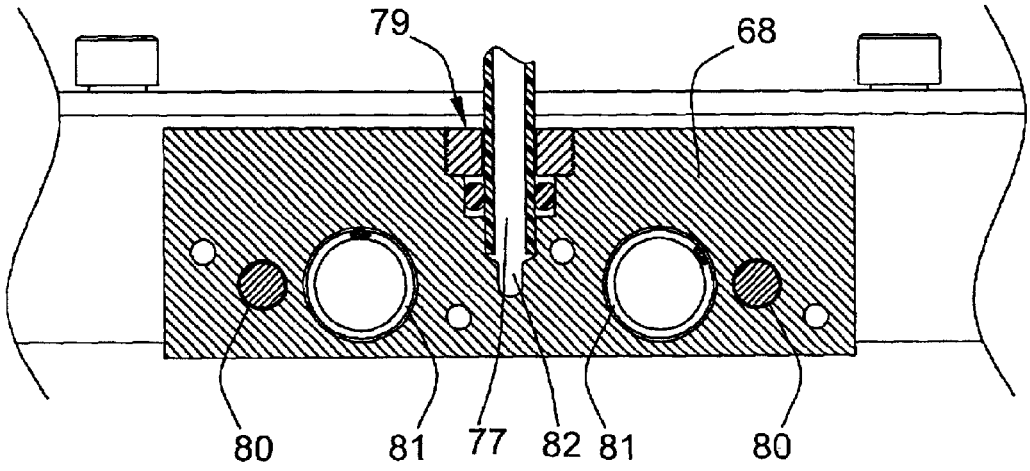

As indicated in FIGS. 5 and 7*a,* pins 80 are used to mount each dispensing head 68 on a support bracket in the form of an elongated support bar 78. The pins 80 slidably engage the head 68 to permit linear translation between each head 68 and the transfer roll 30. At least one spring 81 or other similar resilient mechanism is located between the support bar 78 and the head 68 to serve as means for urging the head 68 against the transfer roll 38 with the recess 70 seated against the outer surface thereof. In the preferred embodiment the head includes a sealed flow passageway 82 from the hose 73 to the outlet channel 76. The head 68 includes an inlet port 72 connected to the hose 73 by a suitable fitting 79 for reception of lubricant. To ensure relatively even lubricant distribution and pressure in the channel 76, multiple ports 84 are provided to connect the outlet channel 76 to an elongated lubricant collection chamber 86 inside the head 68.

Figure 4:
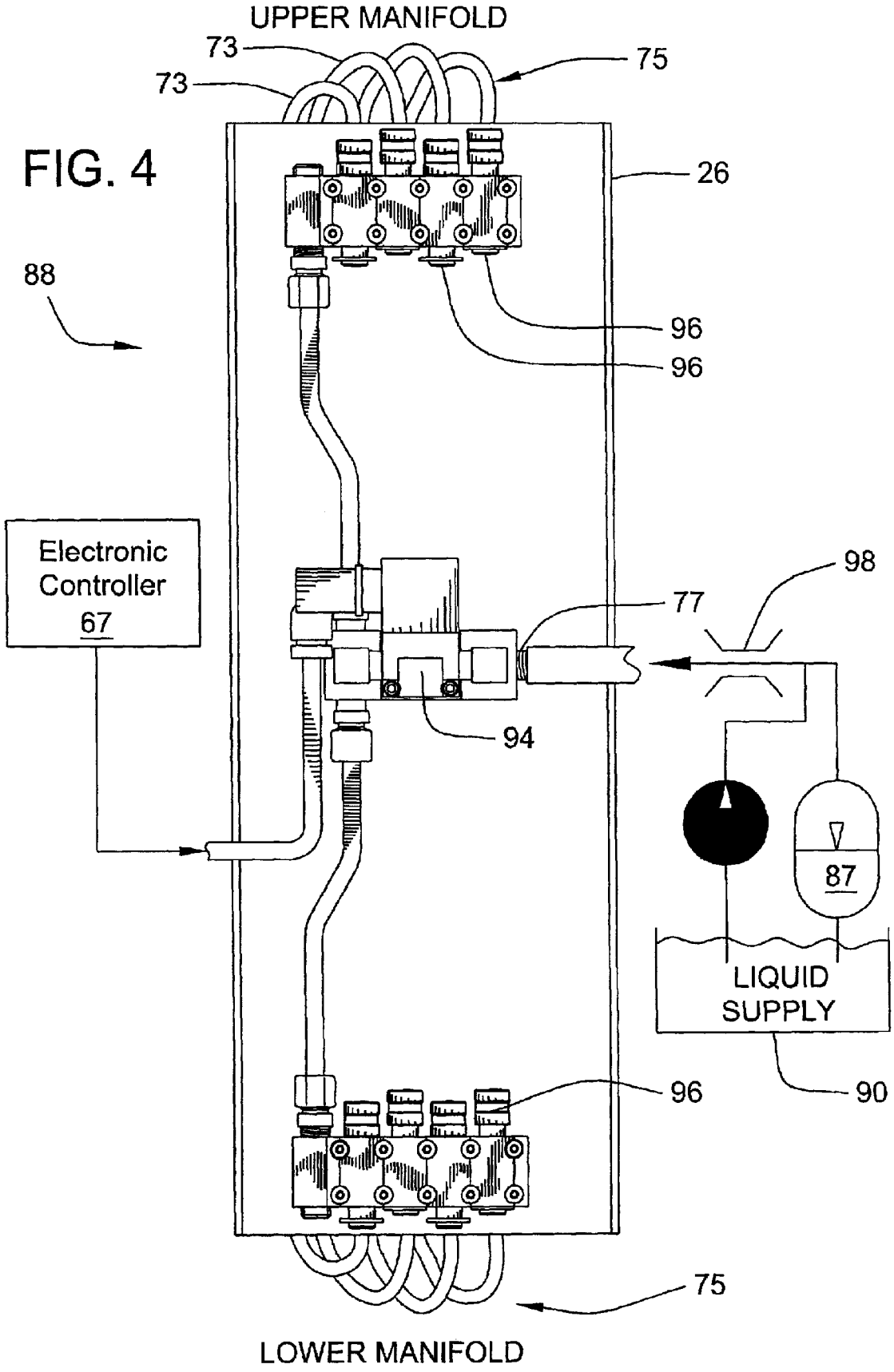
FIG. 4 is a side elevation view of the roller coater apparatus of FIG. 1, shown in partial schematic form, illustrating the lubricant supply assembly in greater detail.

Referring to FIGS. 1, 4 and 8, the roller coater apparatus 20 also includes a lubricant supply assembly 88 to feed and supply the dispensing heads 68 with lubricant. The lubricant supply assembly 88 is fed externally from either an air pressurized pressure pot 87 or fixed displacement (or variable displacement) pump 89, such as a piston pump, or both. The pump 89 or pressure pot 87 generally drive lubricant from a supply reservoir 90 into the inlet 77 of the lubricant supply assembly 88. The lubricant supply assembly 88 generally includes a control valve in the form of an electrically actuated solenoid valve 94, multiple on/off control valves 94, one for each dispensing head 68, and upper and lower supply manifolds 75 that include a hose 73 for each dispensing head 68. The on/off control valves 96 are manually operable and turn on or shut off flow to each of the dispensing heads 68. The control valves 96 are located in upper and lower sets in convenient locations for the upper and lower manifolds 75.

It is an aspect of the present invention, that an electronic controller modulates the electrically actuated solenoid valve 94 between different flow regulating positions at a selected frequency to set an application rate for lubricant application. It has been found that the modulating action along with the novel lubricant applicator assembly 34 provide a more uniform resulting application to the sheet metal strip 21. The modulating frequency depends upon the desired application rate to the sheet metal strip. In the preferred embodiment, fully open and closed position correspond to the two regulating positions of the solenoid valve 94, although partially open and closed positions may also be used. The electronic controller 67 can recall different application rates and can also compensate for the number of on/off valves that are open and closed. An optional restriction orifice 98 may also be provided upstream of the inlet port 77 for controlling the maximum amount of lubricant flow to the solenoid valve 94.

Figure 12:
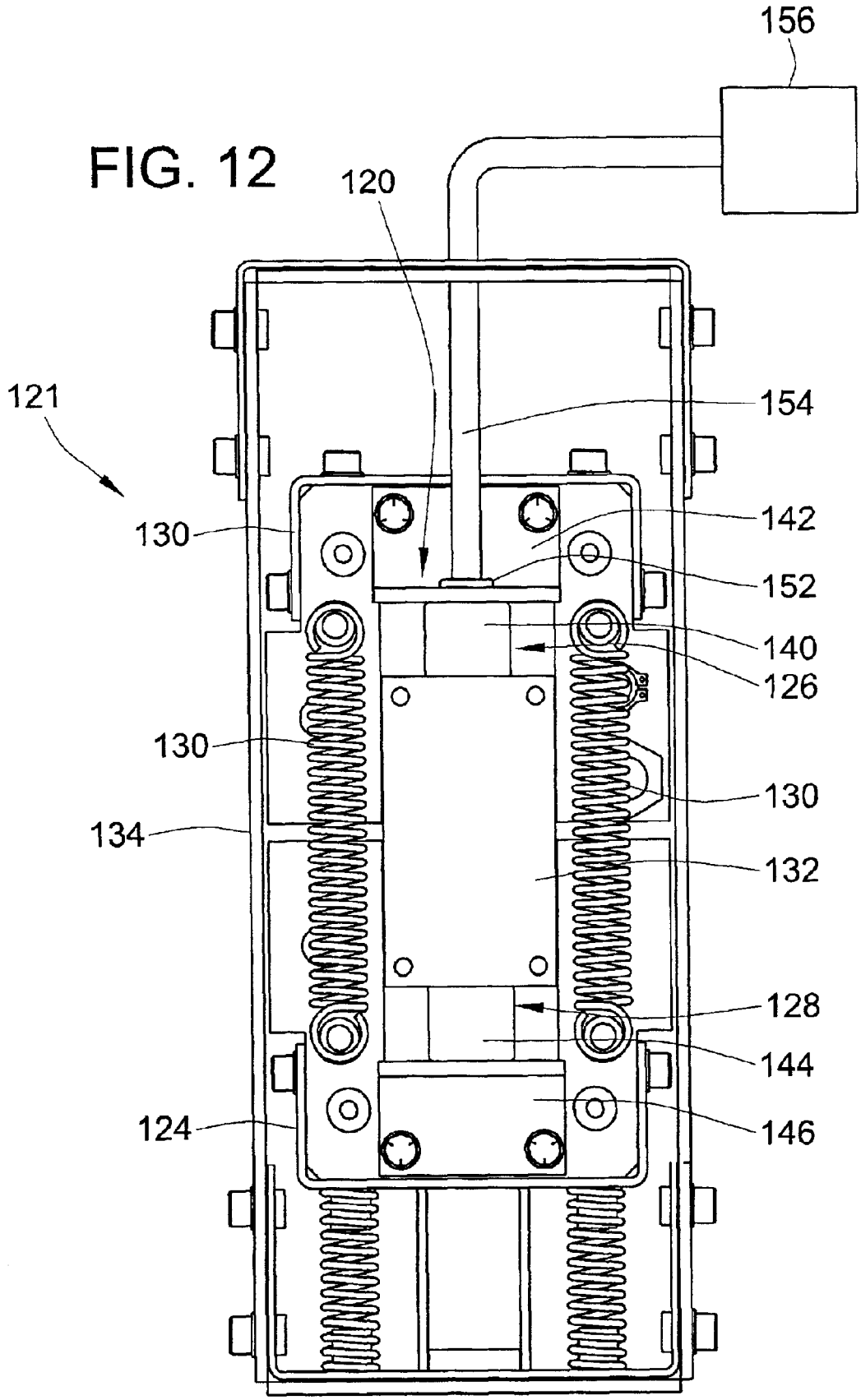
FIG. 12 is a side elevation view of a roller coater apparatus illustrating an alternative embodiment of a fluid actuator mechanism.
Figure 13:
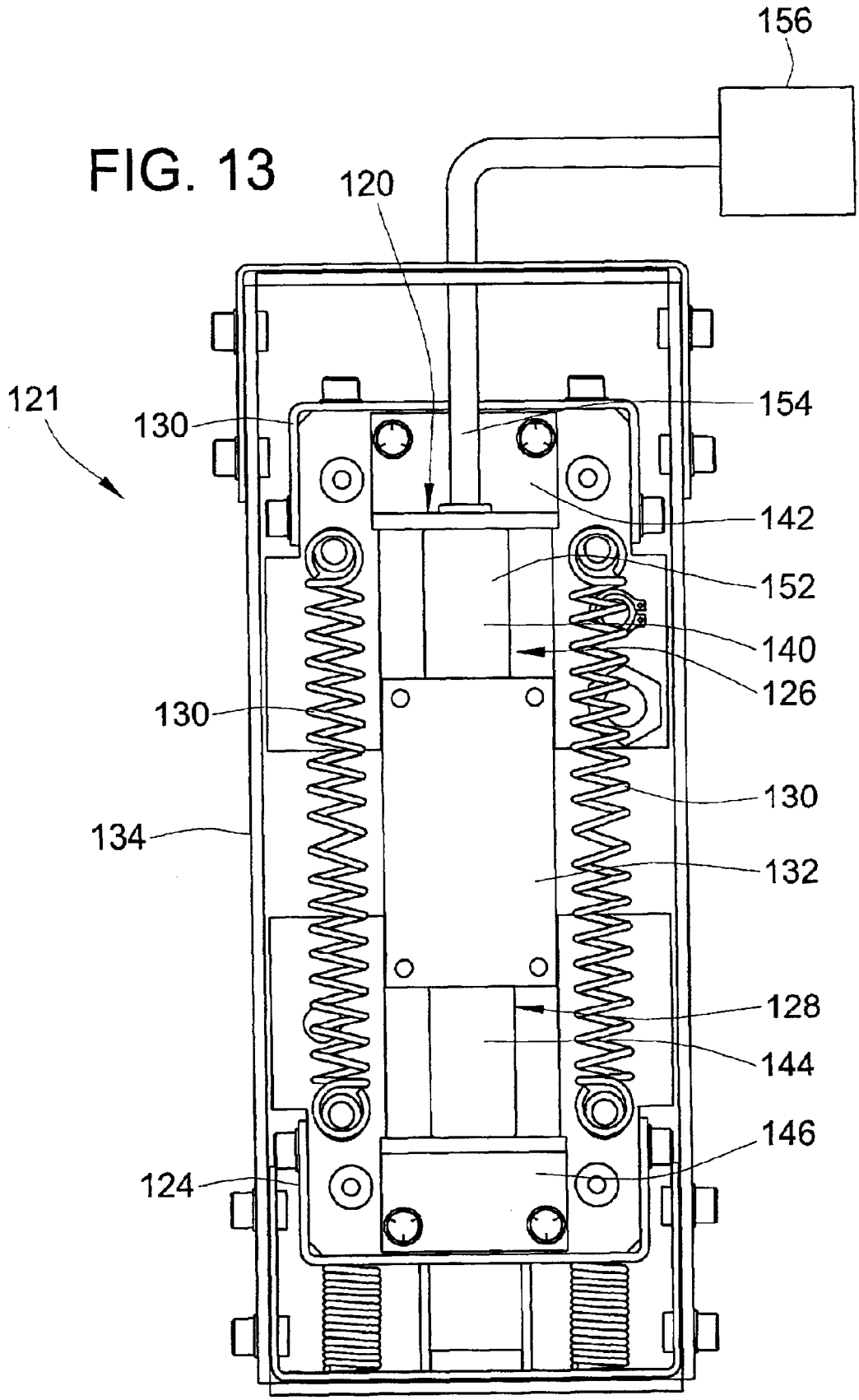
FIG. 13 is the same view as FIG. 12, but with the fluid actuator mechanism in an alternative position.
Figure 14:
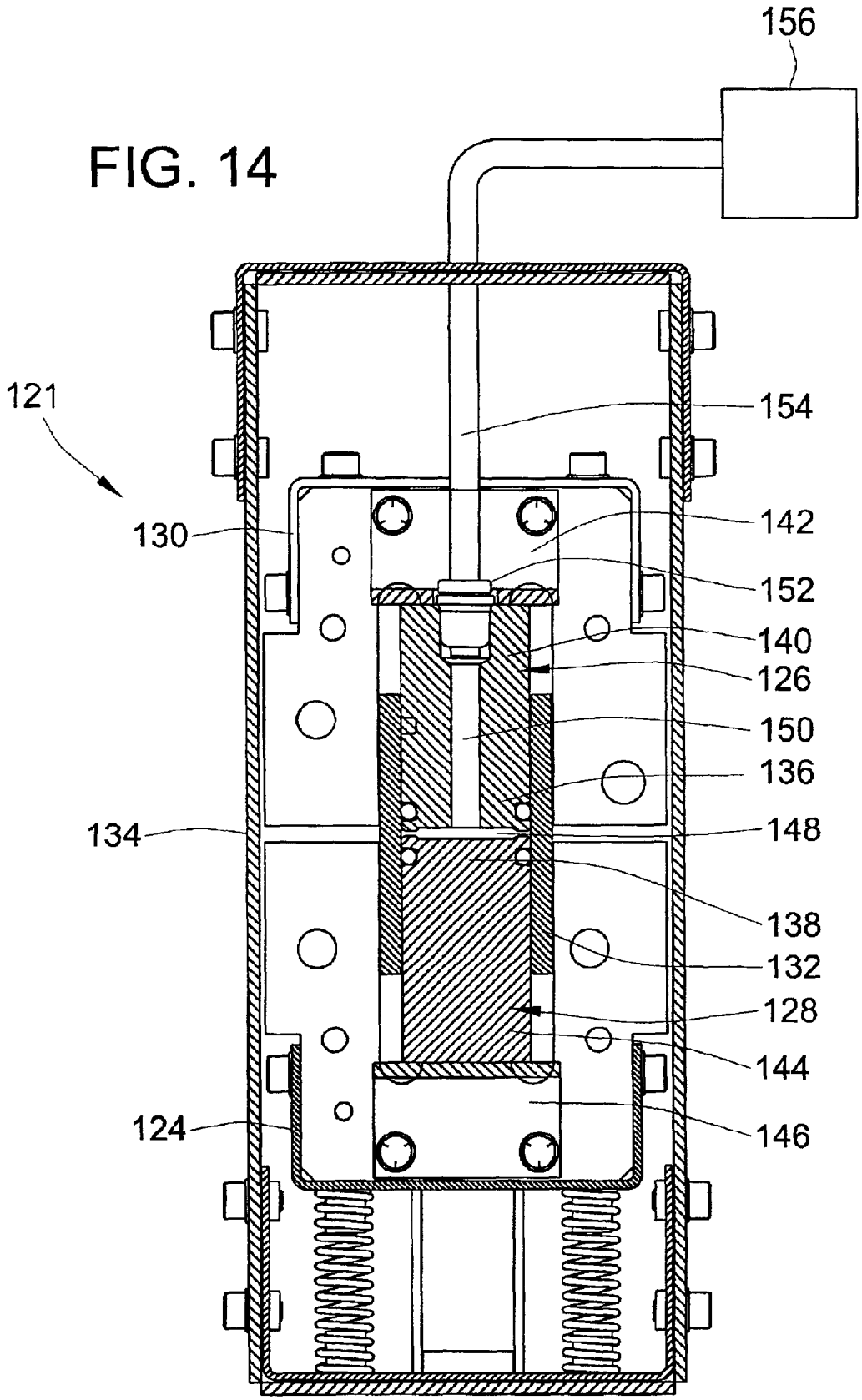
FIG. 14 is a cross section of the fluid actuator mechanism illustrated in FIG. 12.
Figure 15:
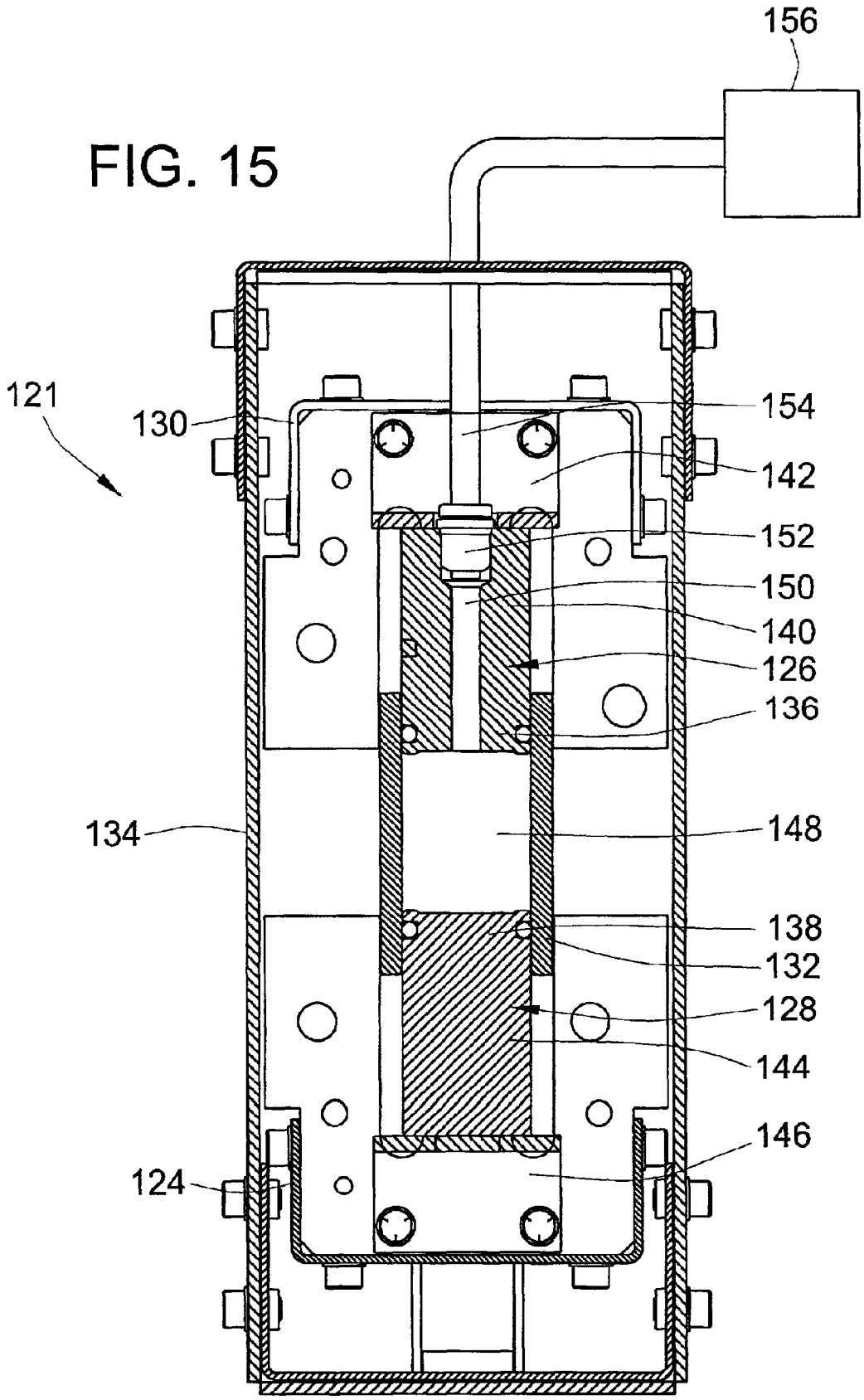
FIG. 15 is a cross section of the fluid actuator mechanism illustrated in FIG. 13.

Turning to FIGS. 12–15, a second preferred embodiment of a fluid actuator mechanism 120 for a roller coater apparatus 121 is illustrated. Similar to the first embodiment, the fluid actuator mechanism 120 drives the upper roller coater carriage 122 and the lower roller coater carriage 124 between a close or engaged position as illustrated in FIGS. 12, 14 for applying laminate to sheet metal and a spread or disengaged position as illustrated in FIGS. 13, 15 for facilitating loading of sheet metal material.

According to this embodiment, the fluid actuator mechanism 120 includes pairs of top and bottom fluid actuators 126, 128 and return springs 130. Although only one end of the roller coater is illustrated with a pair of top and bottom fluid actuators 126, 128 and return springs 130, it will be understood that the actuators 126, 128 and return springs 130 are mounted onto opposing ends of the top and bottom roller coater carriages 122, 124 of the apparatus 121 for balancing purposes (similar to that shown in the first embodiment of FIG. 1 for the pneumatic cylinder assemblies 32).

The top fluid actuator 126 and the bottom fluid actuator 128 share a common cylinder housing 132 that is affixed to the stationary support frame 134 via threaded fasteners (not shown). The top and bottom fluid actuators 126, 128 each include a piston 136, 138 that slides in the common cylinder housing 132. The top piston 136 has a piston rod 140 that acts on an angle iron support member 142 that is fastened to the upper roller coater carriage 122. Similarly, the bottom piston 138 has a piston rod 144 that acts on an angle iron support member 146 that is fastened to the bottom roller coater carriage 124.

Between the top and bottom pistons 136, 138 a single fluid chamber 148 is formed. Pressurization of the chamber 148 drives the pistons 136, 138 and therefore the carriages 122, 124 away from one another. Pressurization and exhaust of the chamber 148 is achieved through a central passage 150 formed through one of the pistons 136 and rods 140. The central passage 136 is connected to a hose 154 through hose fittings 152 mounted through a formed hole in the bottom plate of the top angle iron 142. The hose 154 is secured to a three position valve 156 that is operative to pressurize, exhaust or maintain the pressure inside of the chamber 148.

In operation, when it is desired to load new metal strip into the roller coater or otherwise conduct maintenance, the chamber 148 is pressurized which overcomes the action of the springs 130 drives the pistons 138 and therefore the carriages 122, 124 apart to the spread position illustrated in FIG. 13 and 15. When it is desired to apply laminate material to the sheet of metal between roller coaters, the chamber 148 is exhausted and the springs pull the top and bottom carriages 122, 124 together to pinch the sheet metal material sufficiently to apply laminate to sheet metal material.

In operation, the material running through the apparatus 121 may be subject to elevation differences. This embodiment provides a flotation feature such that the top and bottom roller coaters 122, 124 can float upwardly and downwardly in unison to better ensure more uniform application of laminate. This is achieved due to the fact that the top and bottom fluid actuators 126, 128 share a common chamber 148, such that when one of the pistons rises or falls, it automatically draws the other piston in the same direction. To initially center the top and bottom roller coater carriages 122, 124, and to counteract the natural force of gravity, centering springs 161 may be used to bias the carriages 122, 124 toward the center of the apparatus 121 as shown in FIGS. 12 and 14.

Figure 16:
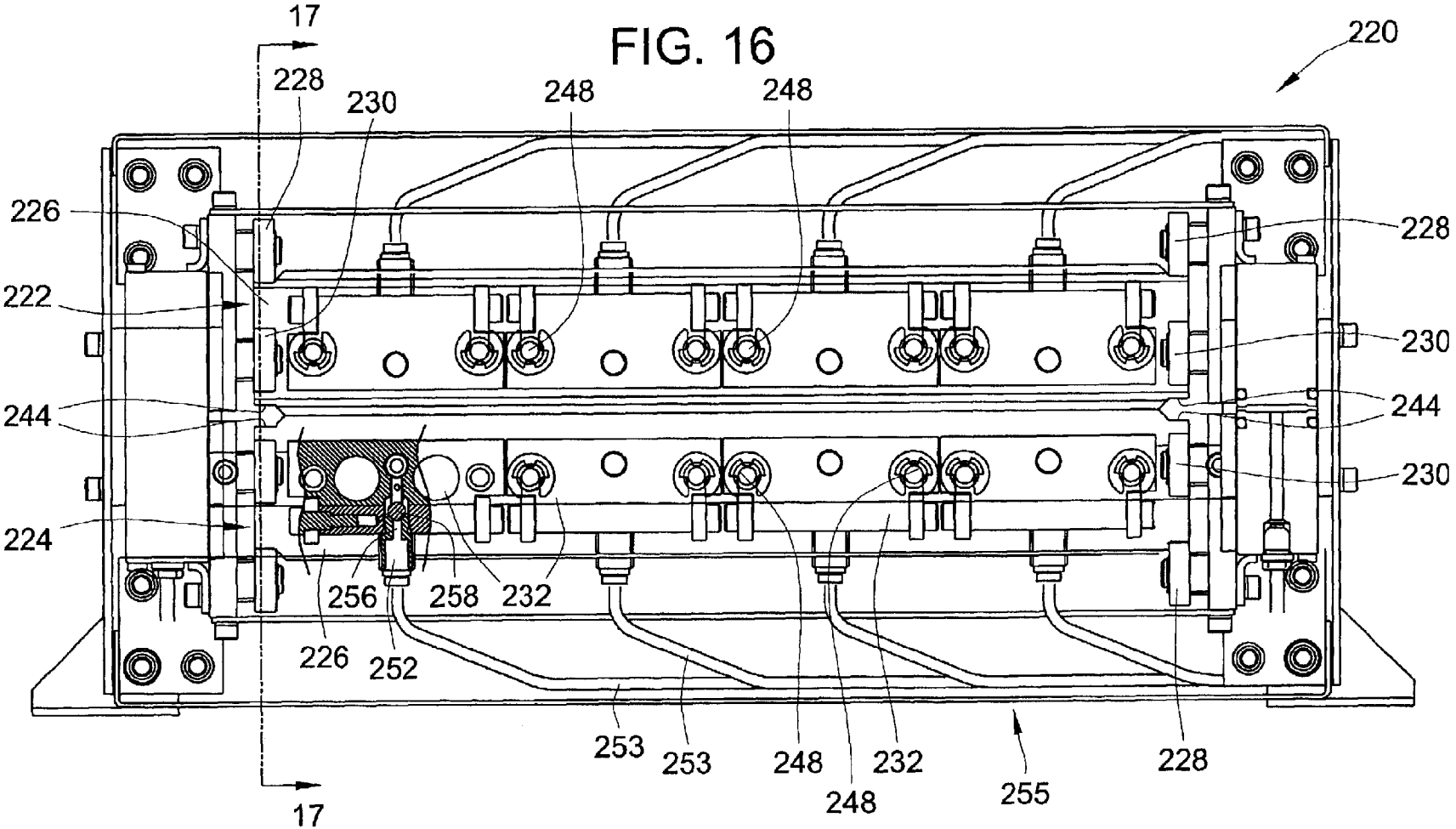
FIG. 16 is a front elevation of a roller coater apparatus according to an alternative preferred embodiment of the present invention with parts of the view shown cut away or in cross section.
Figure 17:
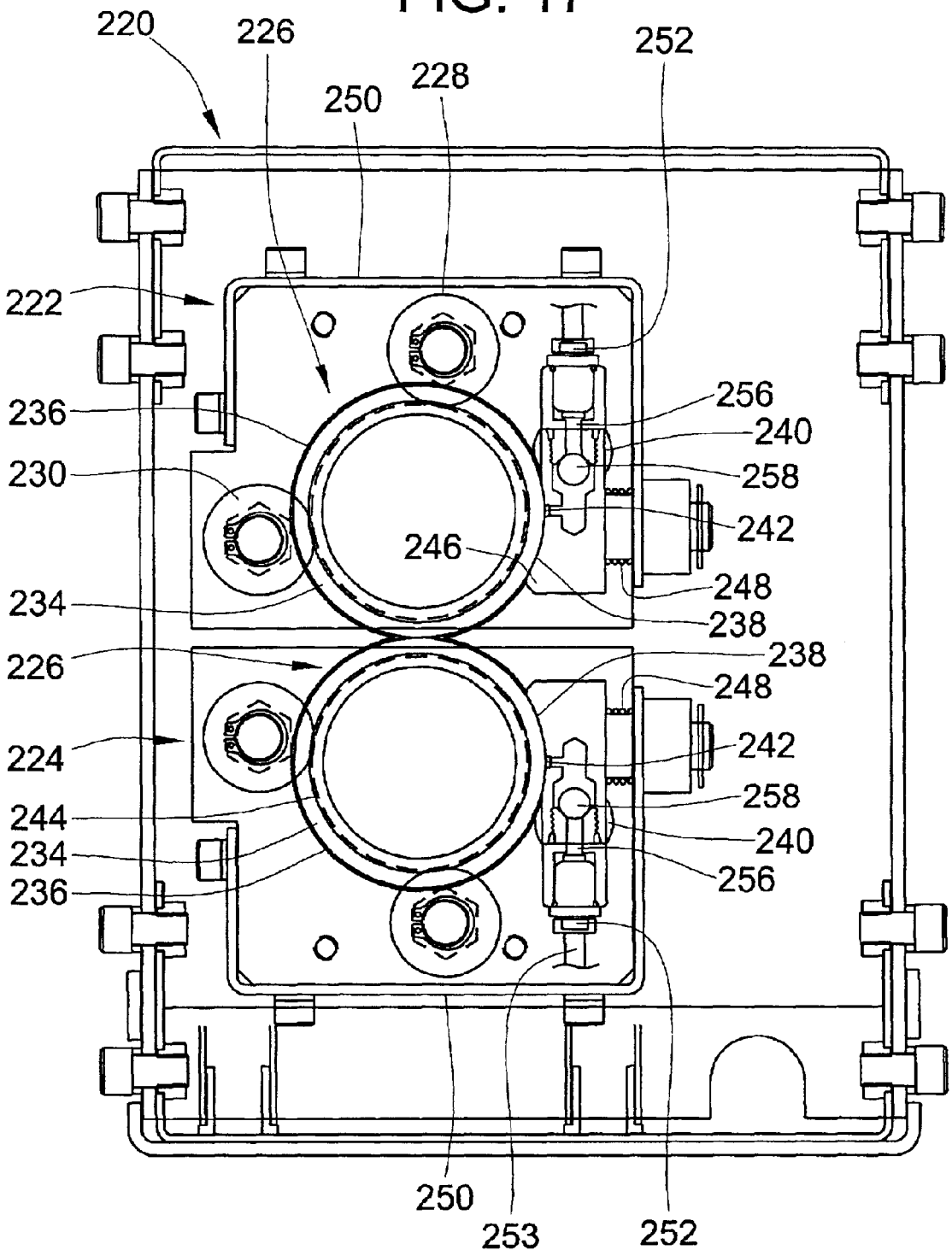
FIG. 17 is a cross section of FIG. 16 taken about line 17—17.

Turning to FIGS. 16 and 17, an alternative preferred embodiment of top and bottom roller coater carriages 222, 224 of a roller coater apparatus 220 is illustrated. Each roller coater carriage 222, 224 includes an applicator roll 226, a pairs of support rolls 228, 230, and one or more lubricant applicator heads 232. In contrast to the first embodiment, in the embodiment shown in FIGS. 16 and 17, the lubricant applicator heads 232 apply laminate directly to the applicator roll 226 without an intermediary transfer roll. The lubricant applicator head 232 may also act as a support to the applicator roll 226.

The applicator roll 226 comprises a metal cylindrical drum 234 with a polyurethane or hard rubber outer cylindrical surface 236. The hard rubber material in the outer surface 236 is capable of picking up the lubricant from the applicator heads 232 and delivering it in a substantially uniform manner to the sheet metal material.

The applicator head 232 has a generally cylindrical, concave recessed surface 238 that receives the outer cylindrical surface 236 of the applicator roll 226. Rollers 240 may be provided at one or both ends of the concave recessed surface 238 (rollers only being shown at one end in FIG. 17), to locate the applicator roll 226 and smoothly guide the outer cylindrical surface 236 of the applicator roll 226 into and/or out of the concave recessed surfaces 238 of the applicator heads 232 (and prevent the applicator head from catching the ends of the concave recessed surface 238).

As shown in FIG. 17, the support rolls 228, 230 are received in cylindrical tracks at recessed ends 244 of the applicator roll drum 234. The support rolls 228, 230 allow the applicator roll 226 to be supported without the need to physically journal the ends of the applicator roll to the top or bottom carriages 222, 224. The support rolls 228, 230 are spaced at different angular orientations about the rotational axis of the applicator roll 226.

In FIG. 17, the top and bottom carriages are driven together in the close or engaged position. When the top and bottom carriages 222, 224 are driven away from each other and apart to the disengaged or spread position to facilitate maintenance or loading of substrate material, the bottom lip 246 of the lubricant applicator heads 232 engage the underside of the applicator roll 226 to support prevent the applicator roll 226 of the top roller coater carriage 222. Thus, separate retainer arms are not necessary to prevent the upper applicator roll 226 from dislodging from the top roller coater carriage 222 when in the spread position.

The applicator heads 232 are biased towards and against the applicator roll 226 via springs 248. Each applicator head 232 is slidably mounted to the frame 250 of the carriage with a sliding mounting mechanism similar to the first embodiment. The springs 248 are supported by the carriage frame 250 and urge the applicator head 232 against the applicator roll 226. The applicator roll 226 may be manually removed from the carriages 222, 224 by pushing the applicator roll 226 against the action of the springs 248 and rotating or sliding the applicator roll 226 out of the carriage where it is carried.

As shown in FIGS. 16 and 17, the applicator heads 232 have a inlet port 252 for receiving laminate from hoses 253 of a fluid manifold 255. The applicator heads 232 also have an internal passage 256 connecting the inlet port 252 to an elongated outlet port 254 that spans a desired section on the outer surface 236 of the applicator roll 226. A check valve 258 may be interposed along the passage 256 to ensure one way fluid flow to the outlet port 254. The fluid manifold 255 is hooked up to a fluid control system as shown for example in FIG. 4 which may be mounted local on the roller coater apparatus 220 or remote therefrom.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for coating metal strip with laminate, the metal strip adapted to be fed through the apparatus, comprising:

a support frame;

top and bottom carriages carried by the support frame and movable relative to the support frame towards and away from each other, the top and bottom carriages supporting top and bottom roller coaters, respectively, the carriages being movable towards each other to a close position pinch the metal strip therebetween for application of laminate and away from each other to a spread position facilitate loading of metal strip;

at least one top fluid actuator and at least one bottom fluid actuator supported by the support frame and acting on the top and bottom carriages, respectively;

a fluid control having a pressurized input, the fluid control being operatively connected to the to top and bottom cylinders, the fluid control being operable to selectively move the roller coaters towards or away from each other; and a fluid connection between the top fluid actuator and the bottom fluid actuator, wherein the top and bottom carriages are movable upwardly and downwardly in unison when the top and bottom carriages are in the close position.

2. The apparatus of claim 1 wherein the further comprising at least one return spring opposing the top and bottom fluid actuators biasing the top and bottom carriages to one of the close and spread positions.

3. The apparatus of claim 2 wherein the at least one return spring is connected between the top and bottom carriages in a state of tension, wherein the at least one return spring biases the top and bottom carriages to the close position.

4. The apparatus of claim 3 wherein pressurization of the fluid connection between the top and bottom fluid actuators drives the top and bottom carriages to the spread position.

5. The apparatus of claim 1 wherein the top and bottom fluid actuators comprise a common cylinder housing mounted to the support frame, the top and bottom fluid actuators having top and bottom pistons acting on the top and bottom carriages, respectively, the top and bottom pistons sliding in the common cylinder housing with a common chamber formed between the top and bottom pistons, pressurization of the common chamber driving the top and bottom pistons apart to position the top and bottom carriages in the spread position.

6. The apparatus of claim 5 wherein the fluid control comprises a valve having a first position connecting the common chamber with the pressurized input and a second position connecting the common chamber with an exhaust port.

7. The apparatus of claim 6 wherein the valve further includes a third position disconnecting the common chamber from both of the exhaust port and the pressurized input.

8. The apparatus of claim 1 wherein the top and bottom fluid actuators are supported by the support frame and connected to the top and bottom carriages, respectively, each fluid actuator comprising a housing defining a control chamber and a piston actuator slidably disposed in the control chamber and dividing the control chamber into upper and lower pressure compartments; further comprising:

a first conduit fluidically connecting the upper and lower compartments of the top and bottom fluid actuators, respectively; and a second conduit fluidically connecting the lower and upper compartments of the top and bottom fluid actuators, respectively.

9. The apparatus of claim 8 wherein the housings of the top and bottom fluid actuators are affixed to the top and bottom carriages, respectively, and wherein the pistons are affixed to the support frame, whereby the pistons are stationary and the housings are movable.

10. The apparatus of claim 1 wherein, each of the roller coaters includes:

an applicator roll contacting the metal strip at a first contact point while in the engaged position for support thereby, the applicator roll adapted to receive and apply laminate, the applicator roll adapted to driven about a predetermined axis of rotation by the metal strip while in the engaged position; and a pair of supports engaging the applicator roll in the engaged position at second and third contact points, the first, second and third contact points being located at different angular positions about the predetermined axis to carry the applicator roll therebetween.

11. The apparatus of claim 10 wherein the roller coaters are movable apart from each other from the engaged position to a disengaged positions wherein the metal strip is not pinched to facilitate loading of metal strip, the upper roller coater further comprising:

support means for supporting the bottom of the applicator roll and retaining the applicator roll in the upper roller coater.

12. The apparatus of claim 11 wherein the support means is two sets of support arms, each set being spaced apart along the predetermined axis, the arms of each set defining fourth and fifth contact points spaced at an angular spacing about to the predetermined axis for holding the bottom of the roller coater, one arm of each set being movable from the other arm to allow for removal of the applicator roller.

13. The apparatus of claim 12 wherein each roller coater further comprises retaining spring loaded stops engaging the axial ends of the applicator roll for axial retention of the applicator roll.

14. The apparatus of claim 12 wherein the apparatus includes a manifold for supplying laminate to the applicator roll, wherein each roller coater further includes:

at least one applicator head having an inlet connected to the manifold for receiving laminate, a longitudinal outlet, and a recessed surface closely receiving the outer peripheral surface of one of the support rolls, the inlet communicating laminate to the outlet for application of laminate to the support roll, the longitudinal outlet being defined in the recessed surface and extending substantially across the axial length of the support roll for applying laminate to the support roll, wherein the support roll contacts the applicator roll along a laminate transfer line parallel with the predetermined axis for application of laminate to the applicator roll.

15. The apparatus of claim 14, further comprising:

a control valve having a pressurized input of laminate and at least two different positions corresponding to different output flows;

a manifold connecting the output flow of the control valve to the at least one head; and means for modulating the valve between the at least two different positions to set an application rate of the controlled amount of laminate, the modulating means being controllable to change the application rate.

16. An apparatus for coating metal strip with laminate, the metal strip adapted to be fed through the apparatus, comprising:

a support frame;

top and bottom carriages carried by the support frame and movable relative to the support frame towards and away from each other, the top and bottom carriages supporting top and bottom roller coaters, respectively, the carriages being movable towards each other to a close position pinch the metal strip therebetween for application of laminate and away from each other to a spread position facilitate loading of metal strip;

a pair of top fluid actuators supported by the support frame on opposite sides of the top carriage and acting on the top carriage;

a pair of bottom fluid actuators supported by the support frame of opposite sides of the bottom carriage and acting bottom carriage; and a fluid control having a pressurized input, the fluid control being operatively connected to the to top and bottom cylinders, the fluid control being operable to pressurize the top fluid actuators and the bottom fluid actuators driving the top and bottom roller coaters toward the spread position;

a fluid connection between the top fluid actuator and the bottom fluid actuator, wherein the top and bottom carriages are movable upwardly and downwardly in unison when the top and bottom carriages are in the close position; and return springs on opposite sides of the top and bottom carriages biasing the top and bottom carriages to the close position.

17. The apparatus of claim 16 wherein the return springs are connected between the top and bottom fluid actuators in a state of tension, wherein the return springs biases the top and bottom carriages to the close position.

18. The apparatus of claim 16 wherein pairs of one of the top fluid actuators and one of the bottom fluid actuators comprise a common cylinder housing mounted to the support frame, the top and bottom fluid actuators having top and bottom pistons acting on the top and bottom carriages, respectively, the top and bottom pistons sliding in the common cylinder housing with a common chamber formed between the top and bottom pistons, pressurization of the common chamber driving the top and bottom pistons apart to position the top and bottom carriages in the spread position.

19. The apparatus of claim 18 wherein the fluid control comprises a valve having a first position connecting the common chamber with the pressurized input and a second position connecting the common chamber with an exhaust port.

20. The apparatus of claim 19 wherein the valve further includes a third position disconnecting the common chamber from both of the exhaust port and the pressurized input.

21. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of discrete supports engaging the applicator roll in the engaged position at second and third contact points, the first, second and third contact points being located at different angular positions about the predetermined axis such that the applicator roll is carried without journalling of the applicator roll in bearings.

22. The apparatus of claim 21 wherein the roller coaters are movable apart from each other from the engaged position to a disengaged positions wherein the metal strip is not pinched to facilitate loading of metal strip, the upper roller coater further comprising:

support means for supporting the bottom of the applicator roll and retaining the applicator roll in the upper roller coater.

23. The apparatus of claim 21 wherein the discrete supports are provided by first and second support rolls.

24. The apparatus of claim 23 wherein sets of said first and second support rolls are provided at opposing ends of the applicator roll, the first and second support rolls being received in cylindrical recess at opposing ends of the applicator roll.

25. The apparatus of claim 21 wherein the laminate is a lubrication suitable for lubrication of a press machine, the apparatus being situated upstream of the press machine lubricating the metal strip prior to reaching the press machine.

26. The apparatus of claim 21 wherein the applicator roll is not physically connected to any part of the apparatus.

27. The apparatus of claim 21 wherein the apparatus includes a manifold for supplying laminate to each of the applicator rolls, wherein each roller coater further includes:

at least one applicator head having an inlet connected to the manifold for receiving laminate, an outlet, and a recessed surface closely receiving the outer peripheral surface of the applicator roll, the inlet communicating laminate to the outlet for application of laminate to the applicator roll, the outlet being defined in the recessed surface and extending substantially across at least a portion of the applicator roll for applying laminate to the applicator roll.

28. The apparatus of claim 27 wherein the at least one applicator head is movable relative to the frame, further comprising a spring mechanism biasing the recess of the applicator head against the applicator roll.

29. The apparatus of claim 27, further comprising:

a control valve having a pressurized input of laminate and at least two different positions corresponding to different output flows;

a manifold connecting the output flow of the control valve to the at least one head; and means for modulating the valve between the at least two different positions to set an application rate of the controlled amount of laminate, the modulating means being controllable to change the application rate.

30. The apparatus of claim 27 wherein the applicator head of the top roller coater includes support means for supporting the bottom of the applicator roll and retaining the applicator roll against the action of gravity.

31. The apparatus of claim 27 further comprising a contact roll mounted to the at least one applicator head engaging the applicator roll to position the applicator roll in the recess of the at least one applicator head.

32. The apparatus of claim 27 wherein the at least one applicator head comprises a plurality of applicators heads across the applicator roll, each applicator head applying laminate to a different section of the applicator roll.

33. The apparatus of claim 27 wherein the applicator roll comprises a rubber material outer coating adapted to receive laminate from the at least one applicator head and carry laminate to the metal strip.

34. An apparatus for coating metal strip with laminate, the metal strip adapted to be fed through the apparatus, comprising:

a support frame;

at least one roller coater carried on the support frame, adapted to engage the metal strip in an engaged position, the roller coater including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of discrete supports engaging the applicator roll in the engaged position at second and third contact points, the first, second and third contact points being located at different angular positions about the predetermined axis such that the applicator roll is carried without journalling of the applicator roll in bearings.

35. The apparatus of claim 34 wherein the applicator roll is not physically connected to any part of the apparatus.

36. The apparatus of claim 34 wherein the apparatus includes a manifold for supplying laminate to the applicator roll, wherein the at least one roller coater further includes:

at least one applicator head having an inlet connected to the manifold for receiving laminate, an outlet, and a recessed surface closely receiving the outer peripheral surface of the applicator roll, the inlet communicating laminate to the outlet for application of laminate to the applicator roll, the outlet being defined in the recessed surface and extending substantially across at least a portion of the applicator roll for applying laminate to the applicator roll.

37. The apparatus of claim 36 wherein the at least one applicator head is movable relative to the frame, further comprising a spring mechanism biasing the recess of the applicator head against the applicator roll.

38. The apparatus of claim 36, further comprising:

a control valve having a pressurized input of laminate and at least two different positions corresponding to different output flows;

a manifold connecting the output flow of the control valve to the at least one head; and means for modulating the valve between the at least two different positions to set an application rate of the controlled amount of laminate, the modulating means being controllable to change the application rate.

39. The apparatus of claim 36 wherein the applicator head includes support means for supporting the bottom of the applicator roll and retaining the applicator roll against the action of gravity.

40. The apparatus of claim 36 further comprising a contact roll mounted to the at least one applicator head engaging the applicator roll to position the applicator roll in the recess of the at least one applicator head.

41. The apparatus of claim 36 wherein the at least one applicator head comprises a plurality of applicators heads across the applicator roll, each applicator head applying laminate to a different section of the applicator roll.

42. The apparatus of claim 36 wherein the applicator roll comprises a rubber material outer coating adapted to receive laminate from the at least one applicator head and carry laminate to the metal strip.

43. The apparatus of claim 34 wherein the discrete supports are provided by first and second support rolls.

44. The apparatus of claim 43 wherein sets of said first and second support rolls are provided at opposing ends of the applicator roll, the first and second support rolls being received in cylindrical recess at opposing ends of the applicator roll.

45. The apparatus of claim 43 wherein the laminate is a lubrication suitable for lubrication of a press machine, the apparatus being situated upstream of the press machine lubricating the metal strip prior to reaching the press machine.

* * * * *